United States Patent [19]

Licciardi et al.

[11] 4,320,792

[45] Mar. 23, 1982

[54] DEVICE FOR ADJUSTING THE HEIGHT AND PROTRUSION OF A ROLLABLE SUN-BLIND

[76] Inventors: Marcello Licciardi; Stefano Licciardi, both of Via Taddeo da Sessa 12, Rome, Italy

[21] Appl. No.: 48,343

[22] Filed: Jun. 14, 1979

[30] Foreign Application Priority Data

Jun. 19, 1978 [IT] Italy ..... 49934 A/78

[51] Int. Cl.[3] ..... E04F 10/06

[52] U.S. Cl. ..... 160/74; 160/82

[58] Field of Search ..... 160/72–75, 160/82

[56] References Cited

U.S. PATENT DOCUMENTS

| | | | |
|---|---|---|---|
| 848,216 | 3/1907 | Walger | 160/73 |
| 1,318,226 | 10/1919 | Nugent | 160/82 |

FOREIGN PATENT DOCUMENTS

| | | | |
|---|---|---|---|
| 933079 | 7/1974 | Fed. Rep. of Germany | 160/74 |
| 788667 | 7/1935 | France | 160/74 |
| 343238 | 9/1936 | Italy | 160/74 |

*Primary Examiner*—Philip C. Kannan

*Attorney, Agent, or Firm*—Ernest F. Marmorek

[57] ABSTRACT

A device for adjusting the height and protrusion or overhang of a rollable sun-blind, which includes pivot points for the arms that guide the sun-blind during reeling. These pivot points may be raised or lowered and are controlled by a clutch, so as to be adjusted at any desired point of elevation.

12 Claims, 5 Drawing Figures

DEVICE FOR ADJUSTING THE HEIGHT AND PROTRUSION OF A ROLLABLE SUN-BLIND

FIELD OF THE INVENTION

This invention relates to a device for adjusting the height and protrusion or overhang of a sun-blind and, more particularly, of a rollable sun-blind.

BACKGROUND OF THE INVENTION

Desirable features of rollable sun-blinds include adjustable positioning and ease of storing of the sun-blind. These features are generally found in rollable sun-blinds heretofore. Previous sun-blinds, however, were deficient in that some were controlled by a hand winch which was encumbering, heavy and required a great deal of effort to operate. In addition the pivotable arm which determined the protrusion or overhang of the sun-blind had its fulcrum at a fixed point thereby limiting the positioning of the sun-blind.

Other sun-blinds are wound by helicoidal springs and have pivotable arms which cannot be arrested at desired points intermediate its position.

SUMMARY OF THE INVENTION

It is among the principal objects of the invention to provide a device applicable to a rollable sun-blind which permits the automatic positioning of the blind, both in height and protrusion or overhang without the need for any type of winch or the use of any other type of equipment for its manipulation.

It is another object of the invention to maintain the desired position of the sun-blind despite the force of gravity acting on the blind and its respective frame work, the forces produced by re-winding the blind on the upper roller, and the force of wind or other atmospheric agents.

Further objects and advantages of the invention will be set forth in part in the following specification and in part will be obvious therefrom without being specifically referred to, the same being realized and attained as pointed out in the claims hereof.

With the above and other objects of the invention in view, the invention consists in the novel construction, arrangement and combination of various devices, elements and parts, as set forth in the claims hereof, one embodiment of the same being illustrated in the accompanying drawings and described in the specification.

BRIEF DESCRIPTION OF THE DRAWINGS

For a fuller understanding of the nature and objects of the invention, reference is had to the following detailed description, taken in connection with the accompanying drawings, in which.

DESCRIPTION OF THE PREFERRED EMBODIMENTS

Figure 1:
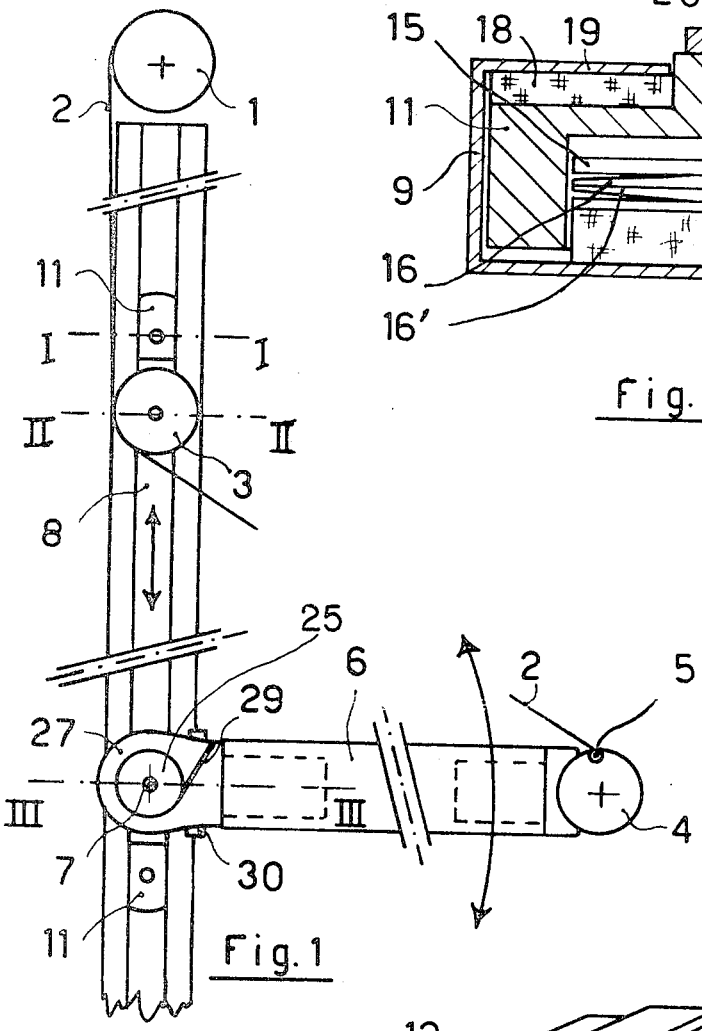
FIG. 1 is a fragmentary elevational view of an embodiment of the present invention.

In carrying the invention into effect in one of the embodiments which has been selected for illustration in the accompanying drawings and for description in the specification, and referring now particularly to FIG. 1, there is provided a reel means, such as wind-up roller 1, which dispenses a sun-blind 2. This sun-blind 2 passes over a directing means such as an idle return roller 3. The end of the sun-blind 2 is fastened to a pipe 4, within a longitudinal groove 5 thereof. The pipe 4 is secured to the end of a projecting means such as two pivotable arms 6. Each of these arms 6 has its fulcrum at axis 7, on moving means or slider 8. This slider 8, shown in FIG. 2, moves in the inner groove of a longitudinal guide means, such as the vertical slide 9, which is hollow and has a slot extending throughout its length.

Figure 2:
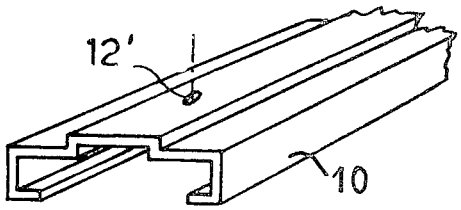
FIG. 2 is a fragmentary large scale perspective view of a detail shown in FIG. 1.
Figure 2:
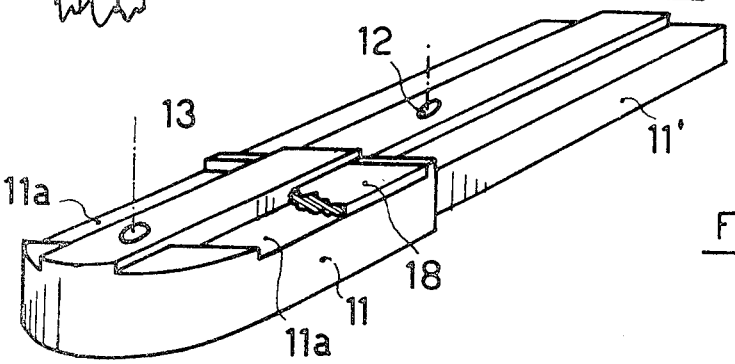

The slider 8 includes a channel 10; at each end thereof one terminal section 11 is fastened, only one terminal section 11 being shown in FIG. 2. Each terminal section 11 is inserted into the channel section 10, so that holes 12, and 12′ are aligned. The terminal sections 11 and the shaped section 10 are then fastened to one another by a fastening element extending through the aligned holes 12 and 12′.

Figure 3:
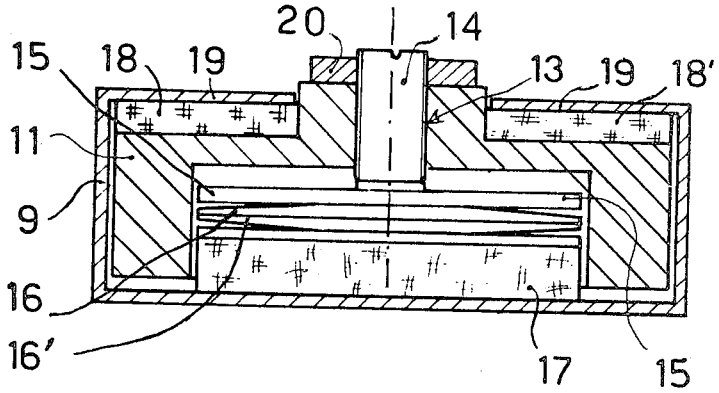
FIG. 3 is a large scale sectional view, taken along the line I—I of FIG. 1.

FIG. 3 shows interlocking means or a clutch fastened on the two terminal sections 11 of the slider at hole 13. A headless screw 14 is threaded into the hole 13 of the terminal section 11. The headless screw 14 exerts pressure on a rigid disk 15, which is in contact with the top of a cup spring 16. A second cup spring 16′ is disposed between the first cup spring and the washer 17. The bottom surface of the washer 17 contacts the inner surface of the vertical slide 9. On a terminal section 11 are two cavities 11*a*, into which two washers 18 and 18′ are inserted. These washers 18 and 18′ exert pressure on the inner surface of the slide 9 along the edges 19, so that between the terminal section 11 and the slide 9 are two opposed clutch surfaces. This pressure exerted on the slide 9 can be adjusted by means of headless screw 14. The headless screw 14 can be locked on the terminal section 11 by means of a nut 20. Elevator means, operable to position the projecting means 6, include moving means 8, longitudinal guide means 9, and interlocking means 14, 15, 16, 16′, 17, 18, 19, and 20.

Figures 4, 5:
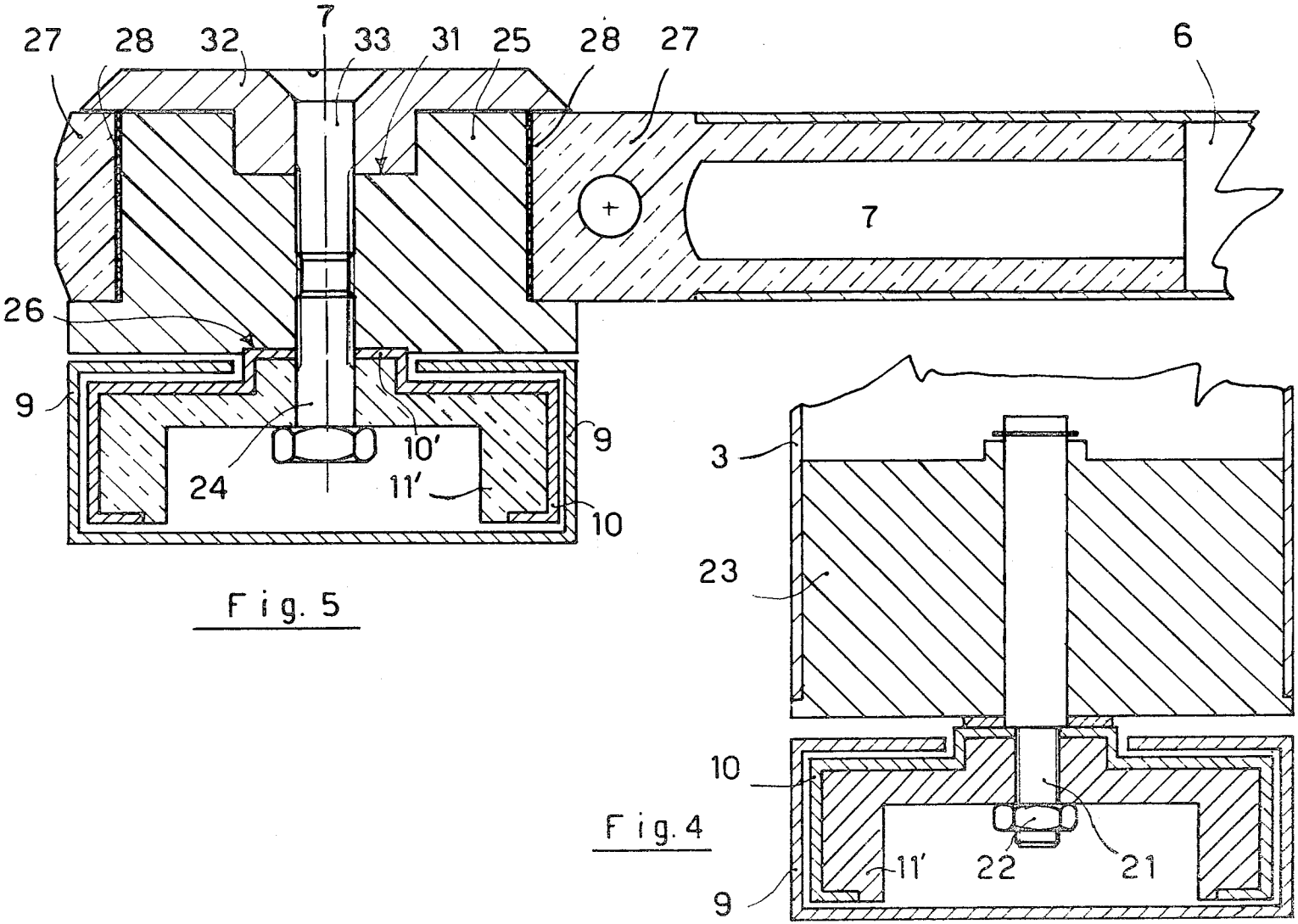
FIG. 4 is a large scale sectional view, taken along the line II—II of FIG. 1.
FIG. 5 is a large scale sectional view, taken along the line III—III of FIG. 1.

A part of the terminal section 11 is fastened to the channel 10 of the slider 8 by pivoting means, such as a shaft 21, as shown in FIG. 4, extending through aligned holes 12 and 12′. This shaft 21 is threaded into the aligned holes 12 and 12′, and is secured by a nut 22. A drum 23 is mounted on the shaft 21, so that it can rotate freely. The return roller 3 is attached to the drum 23. Another part of the terminal section 11′ is mounted on the channel 10 in the same manner, with the exception that the hole 12 is not threaded. The absence of any thread in the hole 12 permits the insertion of a bolt 24 thereinto, which bolt 24 is screwed onto a cylinder 25. This cylinder 25 has a groove 26 formed along its diameter on one side, which matches the complimentary upper part 10′ of the channel 10 in such a manner that it eliminates any rotation between the two pieces. There is a clutch washer 28 disposed between the head 27 of the arm 6 and the cylinder 25. The head 27 is formed with a split 29, as shown in FIG. 1, in order to permit the tightening of the head 27 by means of the bolt 30. This bolt 30 adjusts the friction between the surfaces contacting the washer 28. It will therefore be appreciated that the pivot means, in this example, the cylinder 25, the head 27, and the washer 28 are normally unlocked for unhindered pivot movement, but may be locked by tightening of the bolt 30, so as to arrest the arm 6 in any desired position. The cylinder has a polygonal cavity 31, which permits the insertion of a circular cap 32. The cap 32 is shaped so as to fit into the cavity 31. The circular cap 32 is fastened to the cylinder 25 by means of a screw 33.

The arm 6 has a quadrangular section, which is inserted into the head 27 to match therewith. The pipe 4 is mounted on the other end of the arm 6 to a suitably anchored edge of the blind 2.

The sun-blind 2, in its closed position, occupies very little space, as the slider 8 can be brought into its extreme upper position with the idle roller 3 touching the rolling-up mechanism 1. The pivotable arm 6 can be positioned so as to overlap the slider 8, while the pipe 4 is positioned beneath the return roller 3.

The length of the slider 8, as well as that of arm 6, can vary according to the type of the desired blind, and this variability is easily attained by cutting the channel 10 and arm 6 to a predetermined length, while all the other elements remain the same.

The functioning of this device provides a sun-blind which is extremely simple and requires little effort to operate.

I wish it to be understood that I do not desire to be limited to the exact details of construction shown and described, for obvious modifications will occur to a person skilled in the art.

Having thus described the invention what I claim is new and desired to be secured by Letters Patent, is as follows:

1. In a sun-blind suspension construction, in combination, reel means operable for rolling up, and, dispensing the sun-blind;

engaging means operable for engaging the free end of the sun-blind;

projecting means supporting said engaging means;

pivot means pivotably supporting said projecting means, and elevator means disposed intermediate said pivot means and said reel means and operable for positioning said projecting means at variable positions in relation to said reel means, including longitudinal guide means spaced at a predetermined distance from said reel means;

moving means movable along said guide means, said projecting means being connected near one end thereof through said pivot means to said moving means; and interlocking means including pressure adjustment means releasably interlocking said moving means with said guide means at an adjustable and substantially uniform pressure at any desired position along the length of said guide means, thereby arresting said one end of said projecting means at any selected position of elevation.

2. In a sun-blind suspension construction, in combination, reel means operable for rolling up and, dispensing the sun-blind;

engaging means operable for engaging the free end of the sun-blind;

projecting means supporting said engaging means, and being operable for positioning said engaging means at variable positions relative to said reel means;

elevator means operable for positioning said projecting means at variable heights in relation to said reel means, comprising:

longitudinal guide means spaced at a predetermined distance from said reel means; and including an elongated hollow guide with a slot that extends at least throughout a part of the length of said guide, moving means movable along said guide means, said projecting means being connected near one end thereof pivotably to said moving means; and interlocking means releasably interlocking said moving means with said guide means at any desired position along the length of said guide means, and including a clutch disposed in said guide means and operable between said moving means and said guide means, said clutch comprising:

a slider having a threaded hole;

a threaded fastening element insertable into said threaded hole with external accessibility for adjustment to one end of said fastening element through said hole in said guide;

a rigid disk, including a side in contact with the other end of said fastening element;

at least one cup spring in contact with the other side of said rigid disk, the compression of said spring being adjustable by said fastening element; and at least one washer disposed between said cup spring and the inner surface of said guide means, whereby loosening of said fastening element permits positioning said slider along said guide, and tightening of said fastening element frictionally arrests said slider along said guide at any desired position, so that said moving means may be frictionally arrested along said guide at any selected position of elevation, and pivot means disposed intermediate said projecting means and said elevator means, said engaging means being spaced apart from said pivot means.

3. A sun-blind suspension construction as claimed in claim 1, wherein said guide means include a directing means mounted thereon for controllably guiding said sun-blind to said engaging means.

4. A sun-blind suspension construction as claimed in claim 3, wherein said directing means is a return roller.

5. A sun-blind suspension construction as claimed in claim 4, wherein said projecting means includes an arm pivotably connected to said pivot means, said arm being movable to and from a closed position, wherein it overlaps said guide means and fits lengthwise between said pivot means and said return roller, said return roller being positionable near said reel means in said closed position.

6. In a sun-blind suspension construction as claimed in claim 5, wherein said pivot means is normally unlocked for unhindered pivoting movement, but may be locked to arrest the arm in any desired position of inclination.

7. A sun-blind suspension construction as claimed in claim 1, wherein said guide means include an elongated hollow guide with a slot that extends at least throughout a part of the length of said guide.

8. A sun-blind suspension construction as claimed in claim 7, wherein said moving means includes a slider slidable within said guide and externally accessible through said slot.

9. In a sun-blind suspension construction as claimed in claim 8, wherein said slider comprises a hollow channel section and two terminal sections, each including a portion telescopable into one end of a channel section and secured thereto.

10. A sun-blind suspension construction as claimed in claim 7, wherein said interlocking means includes a clutch operable between said moving means and said guide means, whereby said moving means may be frictionally arrested along said guide.

11. A sun-blind suspension construction according to claim 10, wherein said clutch is disposed in said guide and includes a slider having a threaded hole;

a threaded fastening element insertable into said threaded hole with external accessibility for adjustment to one end of said fastening element through said hole in said guide;

a rigid disk, including a side in contact with the other end of said fastening element;

at least one cup spring in contact with the other side of said rigid disk, the compression of said spring being adjustable by said fastening element; and at least one washer disposed between said cup spring and the inner surface of said guide means, whereby loosening of said fastening element permits positioning said slider along said guide, and tightening of said fastening element frictionally arrests said slider along said guide at any desired position.

12. In a sun-blind suspension construction according to claim 11 or claim 2 wherein said clutch further includes a second washer disposed between the top of the slider and the inner surface of said guide means.

* * * * *